US010082368B2

(12) United States Patent
Neulaniemi

(10) Patent No.: US 10,082,368 B2
(45) Date of Patent: Sep. 25, 2018

(54) MANUFACTURING METHOD FOR BALLISTIC ARMOR AND BALLISTIC ARMOR

(71) Applicant: Tactical Design and Testing Services Oy, Vantaa (FI)

(72) Inventor: Kari Neulaniemi, Vantaa (FI)

(73) Assignee: TACTICAL DESIGN AND TESTING SERVICES OY, Vantaa (FI)

( * ) Notice: Subject to any disclaimer, the term of this patent is extended or adjusted under 35 U.S.C. 154(b) by 282 days.

(21) Appl. No.: 14/931,227

(22) Filed: Nov. 3, 2015

(65) Prior Publication Data

US 2017/0122707 A1 May 4, 2017

(51) Int. Cl.
*F41H 5/04* (2006.01)

(52) U.S. Cl.
CPC ..... *F41H 5/0414* (2013.01); *F41H 5/0492* (2013.01)

(58) Field of Classification Search
CPC .... F41H 5/0414; F41H 5/0421; F41H 5/0492; F41H 7/02; F41H 7/04; F41H 7/044
USPC ..... 296/187.07; 89/36.08
See application file for complete search history.

(56) References Cited

U.S. PATENT DOCUMENTS 3,699,842 A * 10/1972 Grewing ..... F41H 7/044 89/36.08
5,560,971 A * 10/1996 Emery ..... B32B 5/26 428/911
6,234,564 B1 * 5/2001 Kim ..... B60J 1/1884 296/146.8
6,532,857 B1 * 3/2003 Shih ..... F41H 5/0421 89/36.02
6,826,996 B2 * 12/2004 Strait ..... F41H 5/0414 109/11
7,069,836 B1 * 7/2006 Palicka ..... F41H 5/0421 109/49.5
7,077,306 B2 * 7/2006 Palicka ..... B23K 20/025 228/170
7,698,985 B2 * 4/2010 Tapp ..... F41H 5/013 89/36.02
7,703,375 B1 * 4/2010 Scott ..... B29C 70/08 428/911
8,087,143 B2 * 1/2012 DiPietro ..... F41H 5/0442 109/49.5

(Continued)

OTHER PUBLICATIONS

Finnish Office Action dated Mar. 1, 2016; Application No. 20155776.

(Continued)

*Primary Examiner* — Gregory A Blankenship
(74) *Attorney, Agent, or Firm* — Young & Thompson

(57) ABSTRACT

A method for manufacturing a ballistic armor, includes at least the steps of aligning armor elements in front of a casing provider arrangement, and supplying a casing around the armor elements such that the armor elements remain inside the casing. Further, the method for inserting armor elements to a casing structure, includes at least the steps of manufacturing a casing, and inserting armor elements in the cavities of the casing. Further, a ballistic armor including a number of armor elements capsuled in a casing, and a casing forming a number of longitudinal cavities for the armor elements are also described.

20 Claims, 12 Drawing Sheets

(56) References Cited

U.S. PATENT DOCUMENTS

| | | | | |
|---|---|---|---|---|
| 8,257,814 | B2 * | 9/2012 | Bartus | B32B 3/22 264/171.11 |
| 8,322,268 | B1 | 12/2012 | Booher, Sr. | |
| 8,967,230 | B2 * | 3/2015 | Grozdanich | F41H 5/00 164/100 |
| 8,978,536 | B2 * | 3/2015 | Dodworth | F41H 5/023 296/187.07 |
| 9,658,033 | B1 * | 5/2017 | Perciballi | F41H 5/0421 |
| 2009/0072569 | A1 * | 3/2009 | Engelbart | F41H 5/0428 296/39.1 |
| 2010/0077911 | A1 | 4/2010 | Simovich | |
| 2012/0052222 | A1 * | 3/2012 | Gagne | B29C 70/58 428/34.5 |
| 2012/0160084 | A1 | 6/2012 | Mosser | |
| 2014/0033908 | A1 | 2/2014 | Grozdanich et al. | |
| 2014/0208929 | A1 * | 7/2014 | Willson | F41H 5/0492 89/36.02 |
| 2015/0300784 | A1 * | 10/2015 | Scarinci | F41H 5/013 89/36.02 |
| 2016/0025460 | A1 * | 1/2016 | Sayre | F41H 5/0428 89/36.08 |
| 2017/0122707 | A1 * | 5/2017 | Neulaniemi | F41H 5/0414 |

OTHER PUBLICATIONS

Finnish Search Report dated Mar. 1, 2016; Application No. 20155776.

* cited by examiner

400

500

600

700

800

900

1201

1301

MANUFACTURING METHOD FOR BALLISTIC ARMOR AND BALLISTIC ARMOR

FIELD OF THE INVENTION

Generally the present invention relates to manufacturing methods and related products. In particular, however not exclusively, the present invention pertains to manufacturing methods of ballistic armors and ballistic armor structures/products related thereof.

BACKGROUND OF THE INVENTION

Ballistic protection concerns protection against kinetic energy or pressure caused by projectiles such as bullets, gravity bombs, rockets etc. Ballistic armor works by decreasing the energy density of the projectiles, for example by affecting the shape or postion of the projectile, by breaking the projectile and/or by decelerating the velocity of the projectile. Ballistic armor against pressure caused by ammunition works by absorbing or directing the energy of the shock wave.

A ballistic armor may be produced of almost any material when the mass is sufficient enough. However, especially land, sea and air vehicles benefit when the armor is as light as possible, and further when the armor works as the load-bearing structure. Often there is also a requirement for the armor to fit into a small space, i.e. practically speaking the thickness of the structure needs to be as thin as possible.

Traditionally, metallic structures, for example High Hardness Steels have been used in the production of ballistic armors. However, the cores of some projectiles aimed for penetrating armors, i.e. the penetrator, have such a high hardness that the hardness of the metallic armor structures are insufficient to cause damage to these penetrators. Therefore, the armor structure in these cases works by absorbing the kinetic energy of the projectile. The armor structures intended against these penetrators become excessively massive as a monolithic metallic structure, especially when applied to vehicles.

As known from prior art, ceramic elements and metallic ceramic composites, such as aluminum oxide ($Al_2O_3$), silicon carbide (SiC), boron carbide ($B_4C$), tungsten carbide (WC), boron nitride (BN), silicon nitride ($Si_3N_4$), carbon nitride ($C_3N_4$), titanium diboride ($TiB_2$), may be used in ballistic armors. Such materials may have a hardness sufficient to generate damage to the projectiles. Ceramic materials are known to have high compressive strength, but at the same time weak tensile strength.

The simplest construction principle when using ceramic elements in a ballistic armor is gluing rectangular prism ceramic elements, such as bricks, to a frame structure, such as a fiber composite laminate. The manufacturing methods when using ceramics most often require piling the elements manually on a panel-shaped mold of the desired final product, i.e. because the aftertreatment (for example cutting into shape) of the ceramic elements is difficult due to their high hardness. Typical armors that have ceramics glued to a frame structure do not withstand bending load. Therefore, such armors do not work as load-bearing structures in vehicles, for example. Instead these armor structures form a structural parasitic weight (excessive weight).

According to prior art it is also known that ballistic armors may be improved by, either fully or partly, encapsulating ceramic elements. This is known to i) delay the fracturing of the ceramic surface and the start of the penetration ii) slow down the cracking of the ceramic element iii) keeping the ceramic material in contact with the penetrator and thus increasing the erosion of the penetrator iv) affecting the fracturing and shaping of the ceramic elements caused by a shock wave with the adaption of the ceramic elements and the encapsulating material's acoustic impedance.

Prior art tells that the shock resistance of ceramic elements increases significantly when molten metal, such as aluminum, is casted on top of the ceramic elements. The big difference in the ceramic elements' and aluminium's thermal expansion creates a compressing pretension for the ceramic elements when the molten metal cools down to solid material contracting at the same time.

The manufacturing complexity is a common characteristic for the presented structures. The known structures are also limited to a predefined shape. It has been difficult to adapt existing solutions to serial production as well. Even though there is a clear benefit due to the fact that the ceramic elements get a pretension when compressed by a metal casing, one disadvantage is that the existing methods require high accuracy for dimensional tolerances.

SUMMARY OF THE INVENTION

The objective is to at least alleviate the problems described hereinabove not satisfactorily solved by the known arrangements, and to provide feasible methods to manufacture ballistic armors and to provide feasible ballistic armors related thereof.

The aforesaid objective is achieved by the embodiments of a system in accordance with the present invention.

Accordingly, in one aspect of the present invention, a method for manufacturing a ballistic armor comprises at least the steps aligning armor elements infront of a casing provider arrangement, and supplying a casing around the armor elements such that the armor elements remain inside the casing.

In one embodiment the casing provider arrangement is a metal profile extrusion arrangement extruding a metal profile around the armor elements.

In a further, either supplementary or alternative, embodiment the casing provider arrangement is a metal direct extrusion or indirect extrusion arrangement.

In a further, either supplementary or alternative, embodiment the casing provider arrangement is a pultrusion arrangement.

In a further, either supplementary or alternative, embodiment the armor elements are ceramic elements. The armor elements may be ceramic tiles and/or bricks, for example. The ceramic elements may be rectangular, triangular, cylindrical and/or any other shape suitable for such application. In some preferable embodiments, the rectangular tiles may be 25×25 mm-100×100 mm with a thickness of 3-25 mm, for example. As is understood, other dimensional combinations are possible as well.

In a further, either supplementary or alternative, embodiment the armor elements are hard steels, metal matrix composites and/or fiber composites.

In a further, either supplementary or alternative, embodiment the armor elements are aligned in a row infront of the casing provider arrangement.

In a further, either supplementary or alternative, embodiment the armor elements are arranged to stay in place, such as with a stopper, when the armor elements are covered with the casing.

In a further, either supplementary or alternative, embodiment the armor elements are supported with guides on at least two sides such that the guides move forward when the casing is supplied around the armor elements.

In another aspect of the present invention a method for inserting elements to a casing structure comprises at least the steps manufacturing a casing, and inserting armor elements in the cavities of the casing.

In one embodiment the armor elements are aligned on a conveyor that inserts the armor elements in the cavities of the casing.

In a further, either supplementary or alternative, embodiment the armor elements are attached inside the casing by casting or injecting adhesive material inside the casing via arranged channels.

In a further, either supplementary or alternative, embodiment the armor elements are attached inside the casing by welding a gap arranged to the casing such that the contraction of the weld clamps the armor elements to their places inside the casing.

In a further, either supplementary or alternative, embodiment the armor elements are inserted in the casings after the extrusion process. The armor elements may be inserted in the casings during tension leveling or heat treatment, such as hardening or artificial ageing.

In a further, either supplementary or alternative, embodiment the armor elements are attached inside the casing by mechanical forming such as mangling, rolling, compression molding or other suitable methods.

In a third aspect of the present invention a ballistic armor comprises a number of armor elements capsuled in a casing, and a casing forming a number of longitudinal cavities for the armor elements.

In one embodiment the cavities and armor elements are arranged in layers such that the cavities and armor elements in each layer is overlapping the cavities and layers in an adjacent layer.

In a further, either supplementary or alternative, embodiment the casing is a metallic casing.

In a further, either supplementary or alternative, embodiment the armor elements are ceramic elements. In a further, either supplementary or alternative, embodiment the armor elements are hard steels, metal matrix composites and/or fiber composites.

In a further, either supplementary or alternative, embodiment the ballistic armor comprises two layers of cavities and armor elements.

In a further, either supplementary or alternative, embodiment the ballistic armor comprises a number of intermediate elements between the armor elements, which intermediate elements differ by material attributes from the armor elements.

In a further, either supplementary or alternative, embodiment the casing has a curved structure and wherein the armor elements are arranged in a curved formation.

In a further, either supplementary or alternative, embodiment the cavities and armor elements has varying shapes, such as triangular and/or rectangular shapes, and/or sizes.

In a further, either supplementary or alternative, embodiment at least two casings are connected to each other.

In a further, either supplementary or alternative, embodiment the attachment means allow the casings to turn relative to each other.

In a further, either supplementary or alternative, embodiment the attachment means are shoulder structures that are attached to each other by welding, glueing and/or mechanical attachments.

In a further, either supplementary or alternative, embodiment the cavities and armor elements are arranged such that the layers of armor elements overlap each other in a connecting point of the attachment means.

In a further, either supplementary or alternative, embodiment the ballistic armor is attached to a frame structure, such as the frame of a vehicle.

In a further, either supplementary or alternative, embodiment the ballistic armor is configured to shield against projectiles' penetrators kinetic energy and/or protect against the pressure caused by explosives.

In another, either supplementary or alternative, embodiment the ballistic armor is configured to protect as add-on armor. Alternatively, the ballistic armor is configured to protect as a stand-alone armor. In a stand-alone structure the ballistic armor may comprise a fixed structure that provides sufficient rigidity and/or the ballistic armor may comprise an attachable separate structure that provides sufficient rigidity.

In a further, either supplementary or alternative, embodiment the ballistic armor comprises from rigid and solid material formed material layers that are arranged in a specific order in relation to each other.

In a further, either supplementary or alternative, embodiment the ballistic armor structure may comprise other material layers that may or may not function as ballistic armor.

In a further, either supplementary or alternative, embodiment the casing is arranged in connection with the ceramic elements inside the casing by heat shrinking, hot-forming, cold-forming, casting an adhesive material, injecting an adhesive material, gluing, welding and/or other suitable methods.

The utility of the present invention follows from a plurality of factors depending on each particular embodiment. Due to thermal expansion an extruded profile may, in some embodiments, when cooling down compress the ceramic elements giving them a pretension. In some embodiments the production may be automated. In some embodiments the structure may function both as the ballistic armor and the load-bearing structure, for example in vehicles or fixed constructions.

In some embodiments the structure may be provided as a modular elements. By combining/attaching ballistic armors one may be able to easily build ballistic armors according to different shapes and/or sizes. In some embodiments a damaged ballistic armor may be easily changed to a new one.

In this application a "projectile" describes any object moving with a high velocity such as a frag (fragmentation), a bullet or (other) ammunition.

In this application a "penetrator" describes the part of a projectile, either the whole projectile or part of it, such as a bullet or its core, that penetrates into a ballistic armor structure and which kinetic energy the ballistic armor is supposed to dampen.

The expression "a number of" refers herein to any positive integer starting from one (1), e.g. to one, two, or three.

The expression "a plurality of" refers herein to any positive integer starting from two (2), e.g. to two, three, or four.

Different embodiments of the present invention are disclosed in the dependent claims.

BRIEF DESCRIPTION OF THE RELATED DRAWINGS

Next the invention is described in more detail with reference to the appended drawings in which FIGS. 1*a* and 1*b* are sketches of an embodiment of a manufacturing method of a ballistic armor utilizing an extrusion process in accordance with the present invention.

DETAILED DESCRIPTION OF THE EMBODIMENTS

Figure 1A:
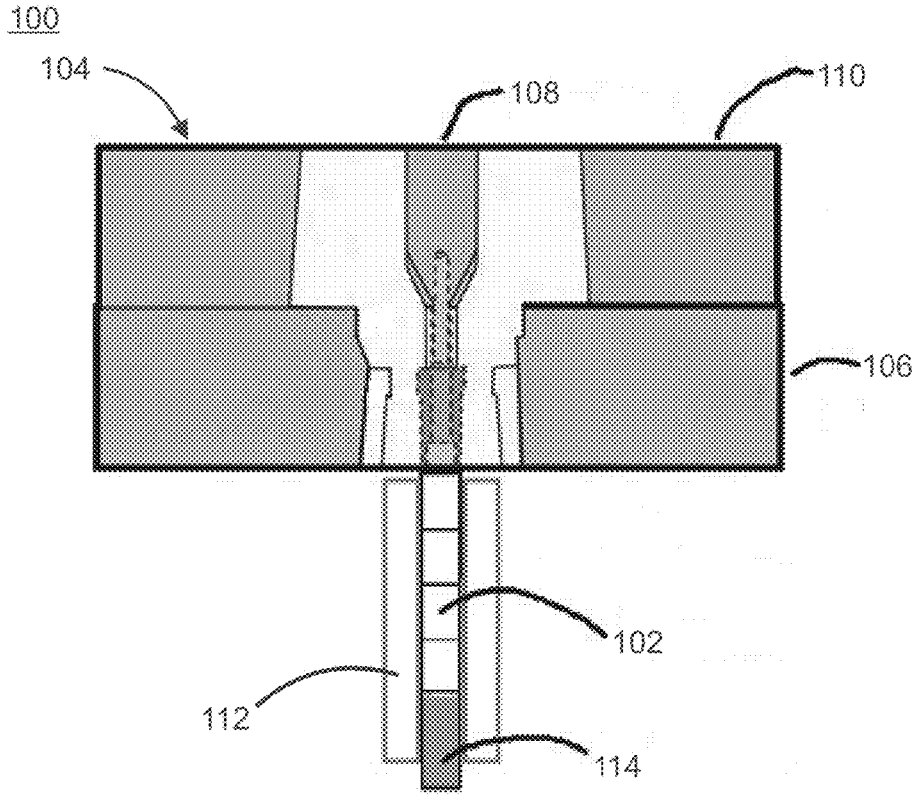

FIG. 1*a* illustrates an embodiment of a manufacturing method 100 in accordance with the present invention. Armor elements 102, such as ceramic tiles, are arranged in connection with a metal profile extrusion arrangement 104. The armor elements 102 are aligned after the die 106 of the metal profile extrusion arrangement 104. The metal profile extruder comprises a mandrel 108 and a mandrel holder 110.

The armor elements 102 are supported with guides 112 and a stopper 114. The metal profile from the metal profile extrusion arrangement pushes the guides 112 forward. The stopper 114 keeps the armor elements 102 in place such that the metal profile settles around the armor elements 102 such that the armor elements remain inside the metal profile.

Figure 1B:
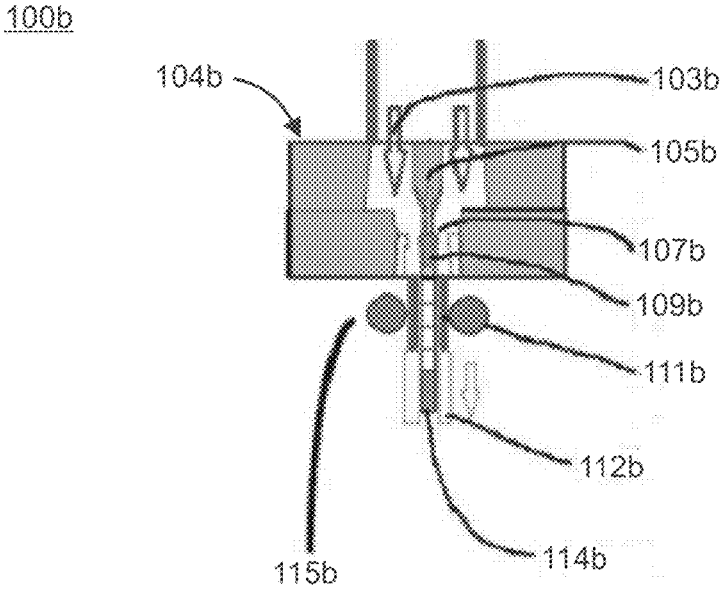

FIG. 1*b* illustrates an embodiment of a manufacturing method 100*b* in accordance with the present invention. The arrows 103*b* represent the malleable material compressed flow. A tongue 105*b* divides the material flow. The metal profile extrusion arrangement 104*b* comprises a weld chamber 107*b* and a bearing 109*b* that forms the extruded metal profile 111*b*. The extruded metal profile 111*b* pushes the guides 112*b* forward. Rollers 115*b* are arranged on both sides of the armor elements to compress the extruded metal profile 111*b* around the armor elements. The rollers 115*b* may also straighten and/or press forward the metal profile 111*b*. The armor elements are supported with a stopper 114*b*.

Metal profile extrusion materials may be e.g. aluminium, brass, copper, lead, tin, magnesium, zinc, steel and/or titanium.

Ceramic elements may comprise for example aluminium oxide, silicon carbide, boron carbide and/or any other ceramic material suitable for ballistic armor and/or suitable for other structural purposes of the present invention.

Figure 2:
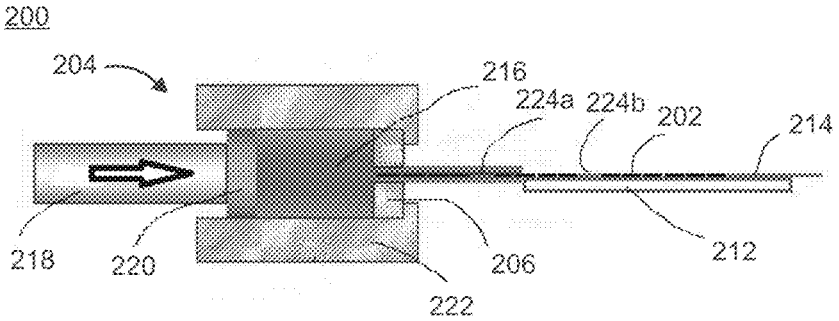
FIG. 2 is a sketch of an embodiment of a manufacturing method of a ballistic armor utilizing a direct extrusion process in accordance with the present invention.

FIG. 2 illustrates an embodiment of a manufacturing method 200 in accordance with the present invention. Armor elements 202 are aligned after a direct extrusion arrangement 204. The armor elements 202 may be arranged directly after the die 206. The billet 216 is driven by a punch 218 with a dummy block 220. The billet 216 is inside a billet chamber 222. The billet 216 is pushed through a die 206. The die 206 forms the billet to a metal profile that is guided around the armor elements 202 such that the armor elements remain inside the metal profile. There may be intermediate elements 224*a*, 224*b* between the armor elements 202. Such intermediate elements 224*a*, 224*b* may be produced from a material that distinguishes from the material of the armor elements 202. The intermediate elements may be manufactured from similar material as the billet for the metal profile, or other material suitable for cutting and machining with standard tools. The intermediate elements may be utilized later on to cut the armor structure on the location of the intermediate elements, for example. Additionally, alternatively, the ballistic armor may be attached to another surface by utilizing the intermediate elements, for example by screwing through the intermediate elements. The armor elements and/or intermediate elements may be supported with guides 212 and a stopper 214. The guides 212 may be pushed forward by the extruded profile.

Figure 3:
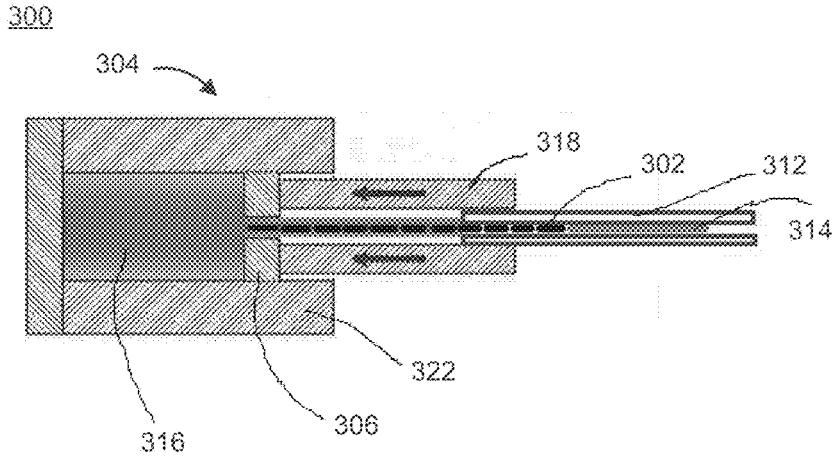
FIG. 3 is a sketch of an embodiment of a manufacturing method of a ballistic armor utilizing an indirect extrusion process in accordance with the present invention.

FIG. 3 presents an embodiment of a manufacturing method 300 in accordance with the present invention. Armor elements 302 are aligned after an indirect extrusion arrangement 304. The armor elements 302 may be arranged directly after the die 306. The billet 316 is inside a billet chamber 322. The billet is driven by a punch 318 with a dummy block that comprises die 306. The die 306 forms the billet to a metal profile that is guided around the armor elements 302 such that the armor elements remain inside the metal profile. The armor elements 302 may be supported with guides 312 and a stopper 314.

Figure 4:
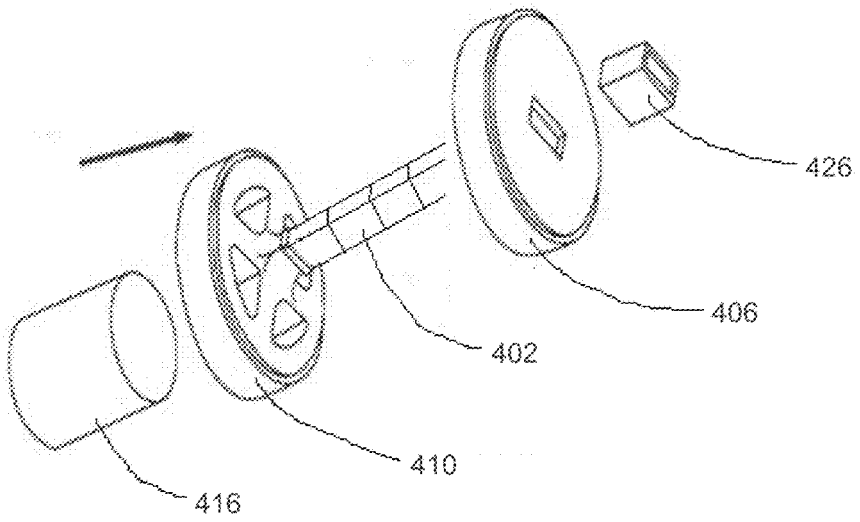
FIG. 4 is a sketch of an embodiment of a manufacturing method of a ballistic armor in accordance with the present invention with a focus on the ballistic elements' placement in relation to the mandrel of an extruder.

FIG. 4 illustrates the position of the armor elements 402 in relation to the mandrel of the metal profile extrusion arrangement. FIG. 4 presents the billet 416, a mandrel holder 406, armor elements 402, a die 406 and an extruded metal profile 426. The extruded metal profile 426 forms a metallic casing around the armor elements 402. The armor elements 402 and the metallic casing 426 forms an embodiment of a ballistic armor in accordance with the present invention.

Figure 5:
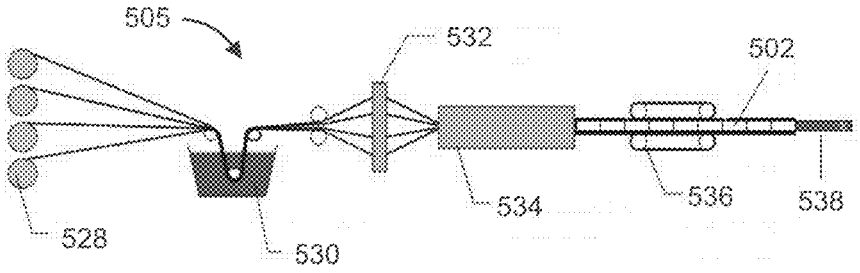
FIG. 5 is a sketch of an embodiment of a manufacturing method of a ballistic armor utilizing a pultrusion process in accordance with the present invention.

FIG. 5 illustrates an embodiment of a manufacturing method 500 in accordance with the present invention. Armor elements 502 are aligned after a pultrusion arrangement 505. Fibers 528 are impregnated with resin 530 and pulled via a guide 532 through a die 534. Resin 530 may for example be polyester, polyurethane, vinylester and/or epoxy. A conveyor 536 may be arranged after the pultrusion arrangement such that the formed casing is guided around the armor elements 502 such that the armor elements remain inside the casing. The armor elements may be supported with a stopper 514 and/or guides. The casing may be manufactured from a fiber composite, such as carbon fiber.

Figure 6:
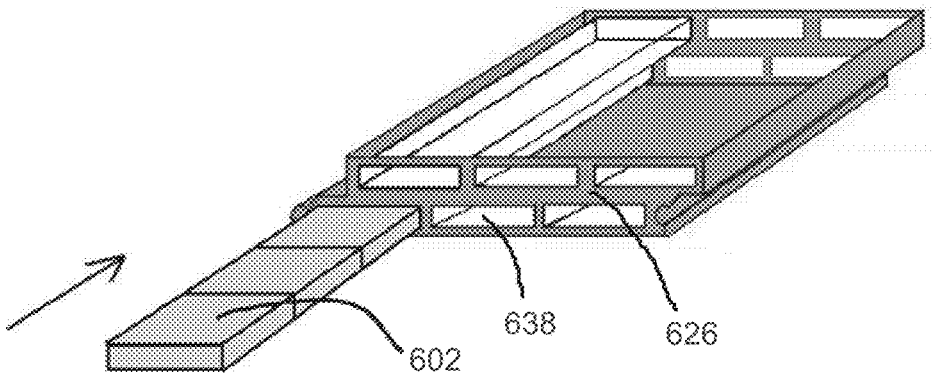
FIG. 6 is a sketch of an embodiment of a method for inserting armor elements inside a casing.

FIG. 6 presents an embodiment of a method 600 for inserting armor elements 602 inside a metal profile/casing 626. The metal profile/casing 626 comprises cavities 638 in which the armor elements 602 may be inserted.

Figure 7:
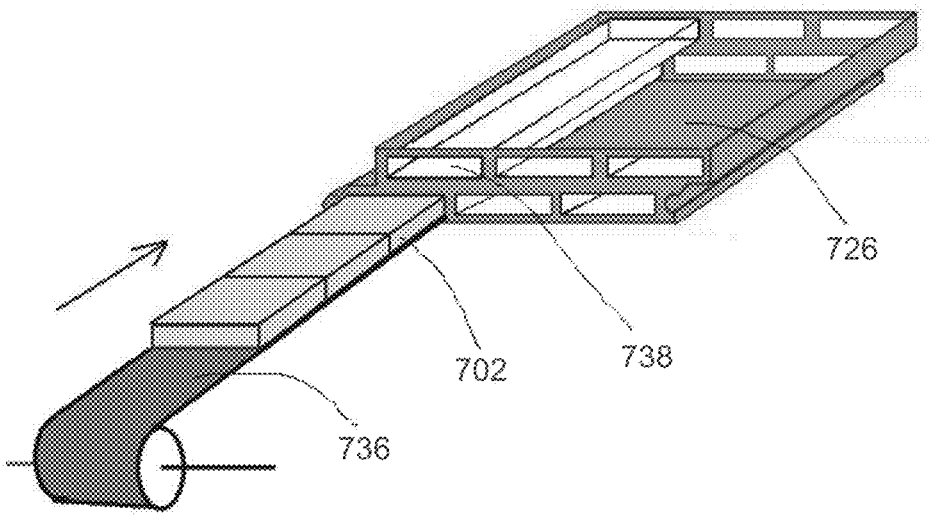
FIG. 7 is a sketch of an embodiment of a method for inserting armor elements inside a casing utilizing a conveyor.

FIG. 7 presents an embodiment of a method 700 for inserting armor elements 702 inside a metal profile/casing 726 utilizing a conveyor 736. The metal profile/casing comprises cavities 738 in which the armor elements 702 may be inserted. The conveyor belt may have an adhesive surface, such as fiber tape or aluminum tape, which allows to place the armor elements on the conveyor belt. The conveyor belt may be fitted with a reel or strip of tape, such as aluminium tape or fiber tape, with adhesive surface which allows to attach the armor elements on the tape placed on the conveyor belt. The tape with the armor elements may be inserted inside the cavity of the metal profile.

Figure 8:
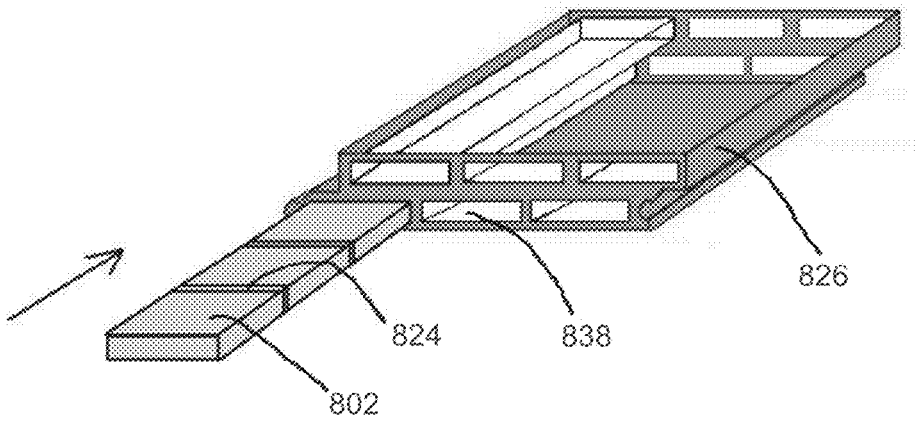
FIG. 8 is a sketch of an embodiment of a method for inserting armor elements and intermediate elements inside a casing.

FIG. 8 presents an embodiment of a method 800 for inserting armor elements 802 and intermediate elements 824 inside a metal profile/casing 826. The metal profile/casing 826 comprises cavities 838 in which the armor elements 802 and intermediate elements 824 may be inserted. The intermediate elements 824 may distinguish from armor elements 802 by material, dimensioning, shape or any other feature. The intermediate elements may have similar cross sectional dimensions as the armor elements, but different length. The intermediate elements may be of similar material as the billet material for the metal casing. The intermediate elements may also be of material with acoustic impedance differing considerably from the acoustic impedance of the armor element material and/or the acoustic impedance of the metal casing material. The intermediate elements 824 may for example act as acoustic impedance shaping elements between the armor elements 802.

Figure 9:
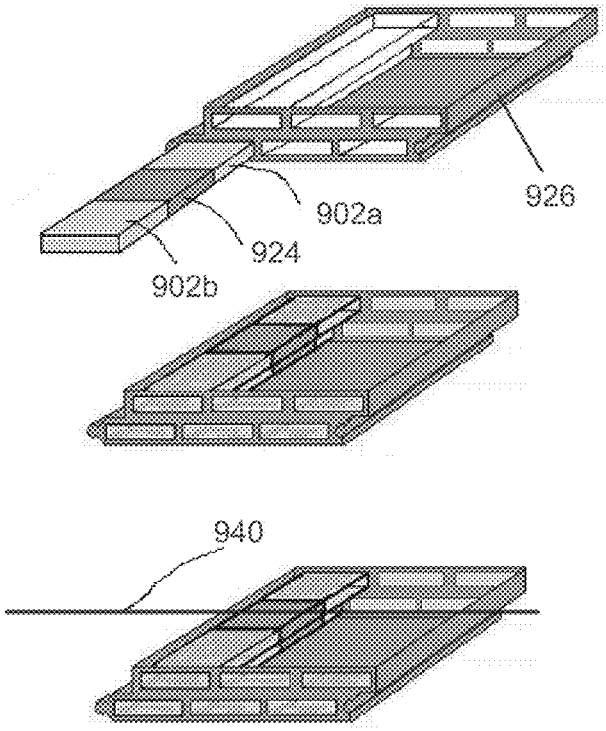
FIG. 9 is a sketch of an embodiment of a method for inserting armor elements and intermediate elements inside a casing with a focus on the casing cut off.

FIG. 9 presents an embodiment of a method 900 for inserting armor elements 902*a*, 902*b* and intermediate elements 924 inside a metal profile/casing 926. The intermediate elements 924 may distinguish from armor elements 902*a*, 902*b* by material, dimensioning, shape or any other feature. The intermediate elements may have similar cross sectional dimensions as the armor elements, but different length, for example. The intermediate elements may be manufactured from similar material as the billet for the metal profile, or other material suitable for cutting and machining with standard tools. The intermediate elements 924 may for example allow to cut off, make openings or in other ways shape the ballistic armor from the desired location 940. By selecting a suitable material for the intermediate elements 924 may allow to cut off or in other ways shape the ballistic armor structure with more conventional working methods than would be needed for cutting off the ballistic armor at the location of the armor elements 902*a*, 902*b*.

Figure 10:
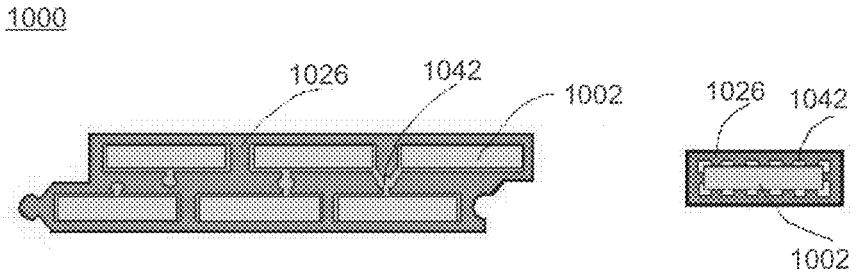
FIG. 10 is a sketch of an embodiment to attach armor elements to a casing structure utilizing adhesive materials inside the casing.

FIG. 10 presents an embodiment of a method 1000 to attach the armor elements 1002 to the metallic casing/profile 1026 with channels 1042 by casting, injecting or any other means applying suitable material inside the casing/profile 1026.

Figure 11:
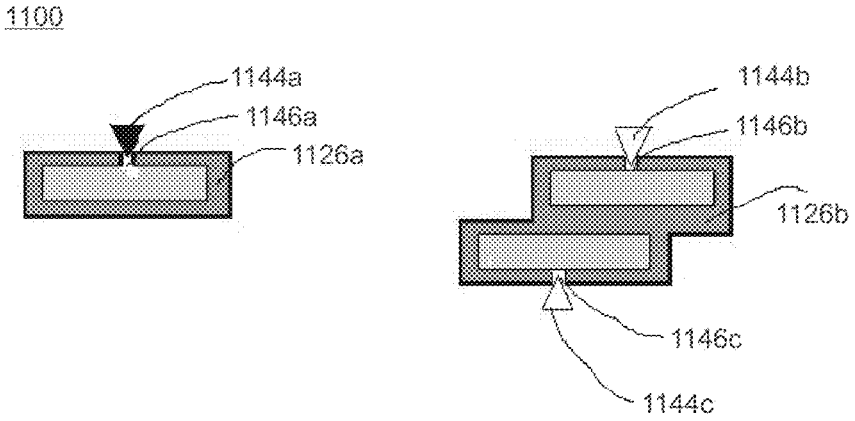
FIG. 11 is a sketch of an embodiment to attach armor elements to a casing structure by welding a gap of the casing.

FIG. 11 presents an embodiment of a method 1100 to attach the armor elements to the metallic casing/profile 1126*a*, 1126*b* by welding 1144*a*, 1144*b*, 1144*c* a gap 1146*a*, 1146*b*, 1146*c* in the metallic casing/profile 1126*a*, 1126*b*. The contraction of the weld 1144*a*, 1144*b*, 1144*c* clamps the armor elements to their places inside the casing/profile 1126*a*, 1126*b* into a prestressed state.

Figure 12:
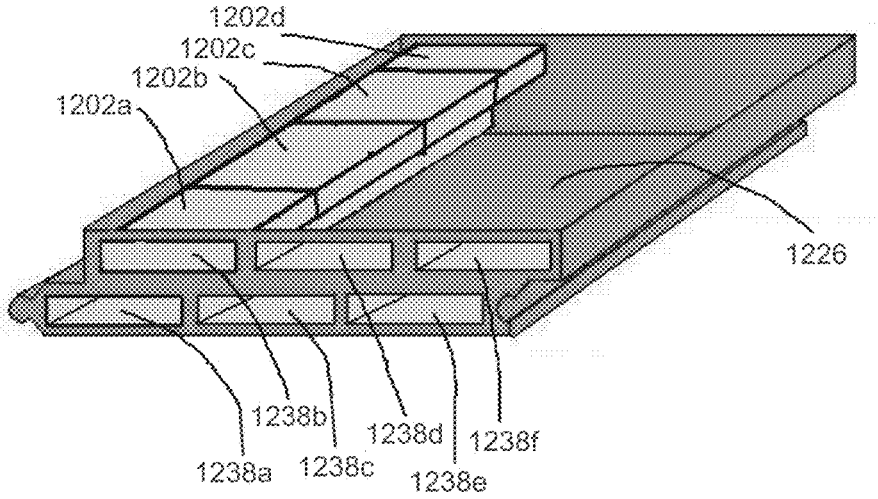
FIG. 12 is a sketch of an embodiment of a ballistic armor structure in accordance with the present invention.

FIG. 12 presents an embodiment of a structure of a ballistic armor 1201 in accordance with the present invention. The ballistic armor comprises a metallic casing 1226. The metallic casing comprises cavities 1238*a-f*. The cavities may be filled with armor elements 1202*a-d*. The casing may comprise cavities in layers.

The cavities in different layers may be overlapping each other. Thereby, the armor elements may also in different layers overlap each other.

Figure 13:
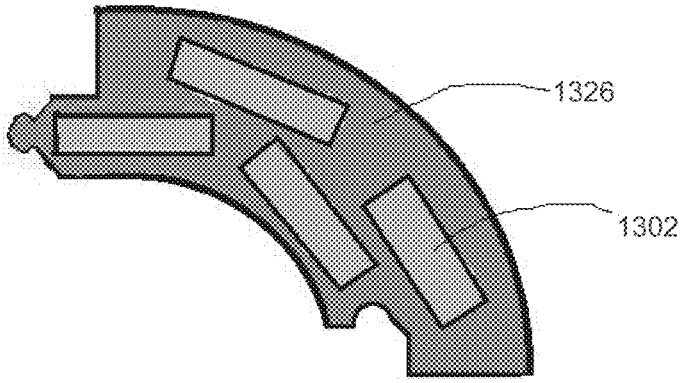
FIG. 13 is a sketch of an embodiment of a curved ballistic armor structure in accordance with the present invention.

FIG. 13 presents an embodiment of a structure of a ballistic armor 1301 wherein the metallic casing 1326 has a curved form and wherein the cavities and armor elements 1302 are arranged in a curved formation within the casing. The armor elements 1302 and the cavities for the armor elements may be rectangle formed.

Figure 14:
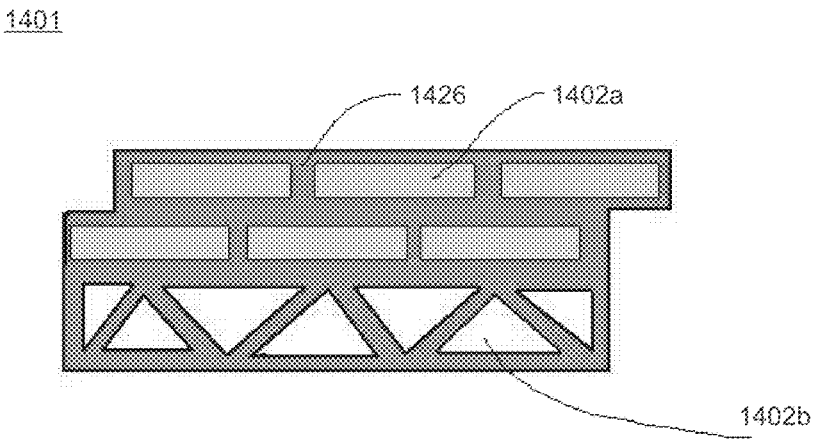
FIG. 14 is a sketch of an embodiment of a ballistic armor structure with armor elements of different shapes and/or sizes in accordance with the present invention.

FIG. 14 presents an embodiment of a structure of a ballistic armor 1401 wherein the metallic casing 1426 comprises cavities with varying shapes and/or sizes. Armor elements 1402*a*, 1402*b* with varying shapes and/or sizes may be inserted in the cavities. Two layers of rectangular shaped cavities and armor elements and one layer of triangular shaped cavities and armor elements are presented in FIG. 14. The triangular shaped armor elements and cavities may be arranged overlappingly such that they together form a rectangular like set, for example. The triangular shaped cavities may also be left empty or may be used for example for chaneling conduits, liquids or gasses.

Figure 15:
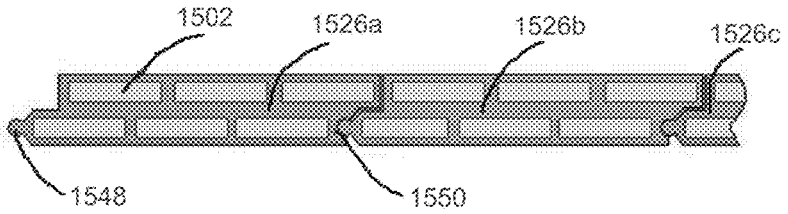
FIG. 15 is a sketch of an embodiment of a ballistic armor structure wherein a plurality of casings are attached to each other.

FIG. 15 presents an embodiment of ballistic armor casings 1526*a*, 1526*b*, 1526*c* attached to each other. The casings 1526*a*, 1526*b*, 1526*c* have cavities that are filled with armor elements 1502. The casings have 1526*a*, 1526*b*, 1526*c* attachment means 1548, 1550 for attaching casings to each other. A casing may have a 'male' attachment mean 1548 on one side and a 'female' attachment mean 1550 on one side, for example.

Figure 16:
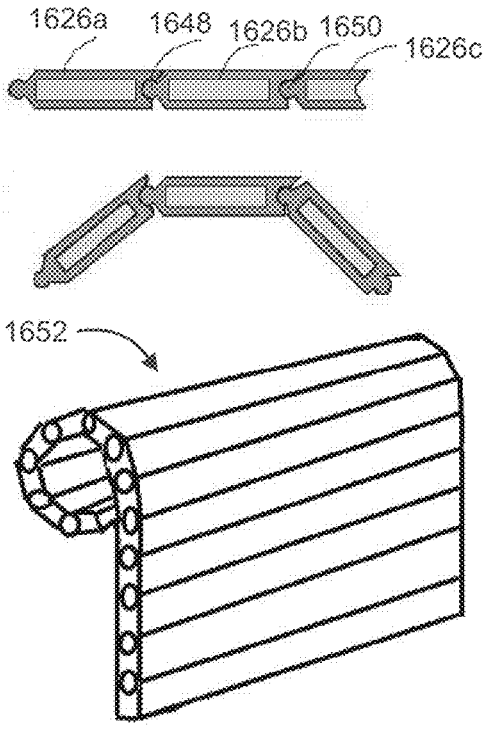
FIG. 16 is a sketch of an embodiment of a ballistic armor structure wherein a plurality of casings are attached to each other and wherein the attachment means turn relative to each other.

FIG. 16 presents an embodiment of ballistic armor casings 1626*a*, 1626*b*, 1626*c* attached to each other, wherein the casings may turn relative to each other. The attachment means 1648, 1650 functions as pivotal points such that the casings may turn relative to each other. In FIG. 16 is also presented an embodiment of the ballistic armor, wherein the ballistic armor functions as a retractable door curtain 1652 or similar structure.

Figure 17:
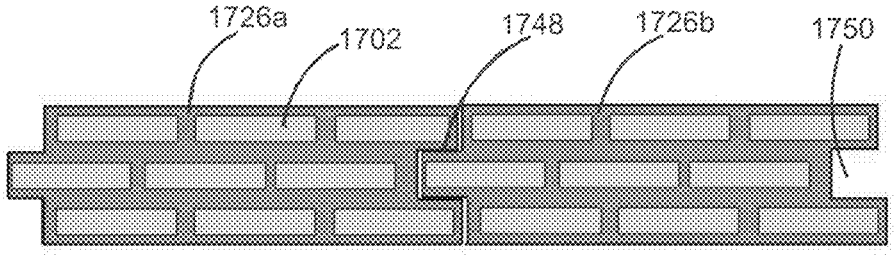
FIG. 17 is a sketch of an embodiment of a ballistic armor structure wherein a plurality of casings are attached to each other utilizing shoulder structures as attachment means.

FIG. 17 presents an embodiment of ballistic armor casings 1726*a*, 1726*b* attached to each other, wherein the casings comprise attachment means 1748, 1750 that are shoulder structures. The attachment means 1748, 1750 may be attached to each other for example by welding, glueing, mechanical attachments or any other suitable means. The cavities and armor elements 1702 are arranged such that the layers of armor elements also overlap in the connecting point.

Figure 18:
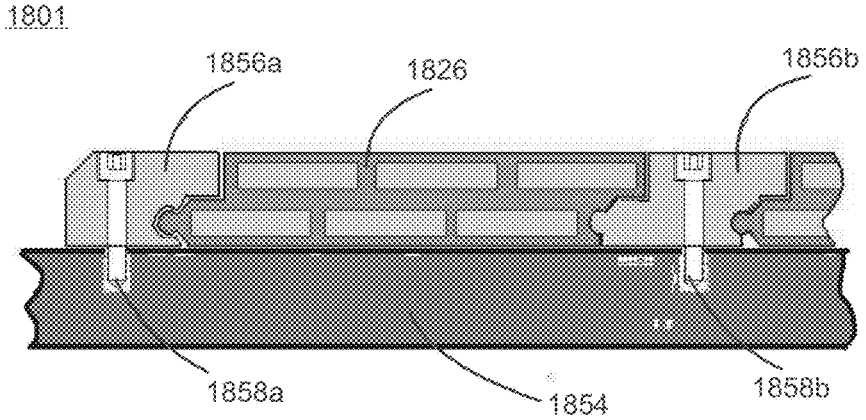
FIG. 18 is a sketch of an embodiment of a ballistic armor structure applied to a frame structure.

FIG. 18 presents an application for the ballistic armor according to the present invention. The casing 1826 may be attached to a frame structure 1854 with attachment elements 1856*a*, 1856*b*. The attachment elements may be attached to the frame structure 1854 with screws 1858*a*, 1858*b*, for example.

Figure 19:
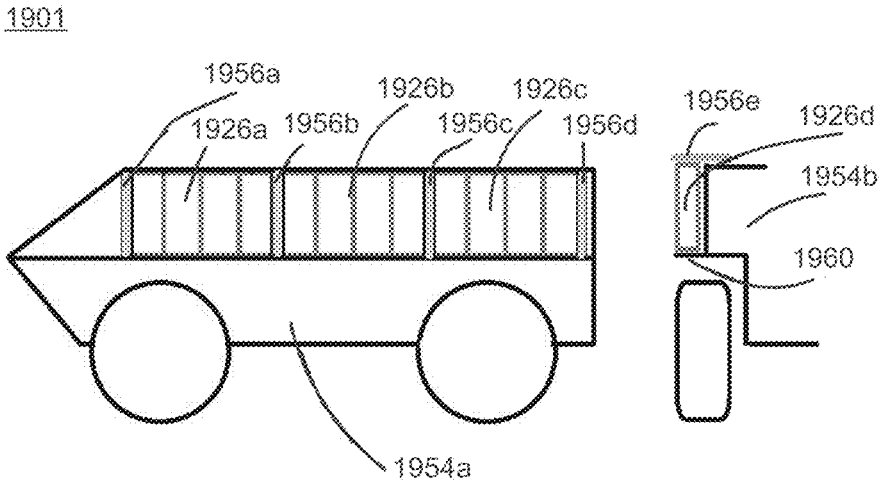
FIG. 19 is a sketch of an embodiment of a ballistic armor structure applied to a vehicle frame.

FIG. 19 presents an application for the ballistic armor 1901, wherein the ballistic armors are used as shields for vehicles. The casings 1926*a*, 1926*b*, 1926*c* are attached to the frame 1954*a*, 1954*b* of the vehicle with attachment elements 1956*a-e*. The casings 1926*a*, 1926*b*, 1926*c* may be supported with a flange 1960 of the vehicle. The casings 1926*a*, 1926*b*, 1926*c* may be attached to each other as well.

Figure 20:
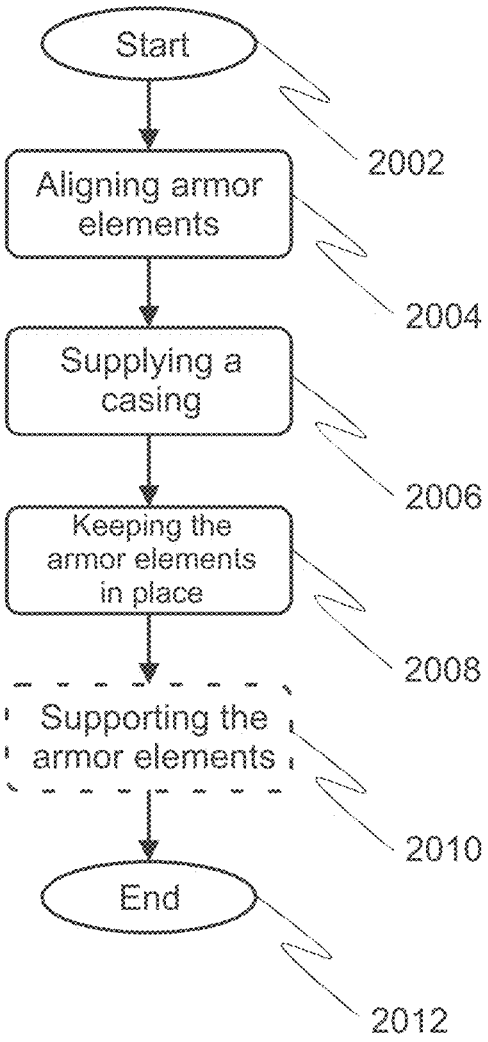
FIG. 20 is a flow diagram of an embodiment of a manufacturing method in accordance with the present invention.

FIG. 20 is a flow diagram of an embodiment of a manufacturing method in accordance with the present invention.

At method start-up 2002, preparatory actions may take place.

At 2004, armor elements are aligned infront of a casing provider arrangement. A casing provider arrangement may be an extrusion or pultrusion arrangement, for example.

At 2006, a casing is supplied around the armor elements such that the armor elements reami inside the casing. The armor elements may be ceramic elements, for example.

At 2008, the armor elements are kept in place for example with a stopper. A stopper may prevent the armor elements of moving when the casing is supplied around the armor elements.

At 2010, the armor elements are supported with guides, for example. The casing may push the guides forward when the casing is supplied around the armor elements.

At 2012, the method execution is ended.

Figure 21:
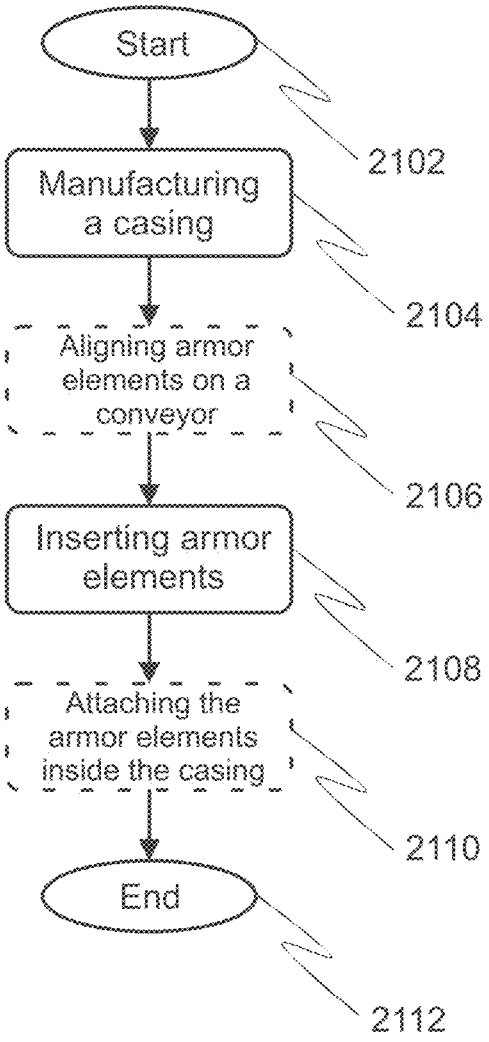
FIG. 21 is a flow diagram of an embodiment of a method for inserting armor elements to a casing structure in accordance with the present invention.

FIG. 21 is a flow diagram of an embodiment of a method for inserting armor elements to a casing structure in accordance with the present invention.

At method start-up 2102, preparatory actions may take place.

At 2104, a casing is manufactured. The casing may be manufactured according to suitable methods. The casing may be a metal profile.

At 2106, armor elements are aligned on a conveyor.

At 2108, the armor elements are inserted in the cavities of the casing. The armor elements may be inserted by utilizing a conveyor as presented in step 2106. The elements may be inserted by other means as well, for example manually.

At 2110, the armor elements are attached to the casing structure. Adhesive material, such as molten metal, may be supplied inside the casing via arranged channels. Alternatively a gap arranged to the casing may be welded.

At 2112, the method execution is ended.

The dotted boxes in FIGS. 20 and 21 can be considered as alternative embodiments.

Consequently, a skilled person may on the basis of this disclosure and general knowledge apply the provided teachings in order to implement the scope of the present invention as defined by the appended claims in each particular use case with necessary modifications, deletions, and additions.

The invention claimed is:

1. A method for manufacturing a ballistic armor, comprising:

aligning armor elements in front of a casing provider arrangement with respect to a formation direction of the ballistic armor, the armor elements each comprising a first side and a second side opposite the first side and facing the casing provider arrangement; and supplying a uniform casing at at least the second side of at least one of the armor elements in the formation direction of the ballistic armor and around the armor elements such that the armor elements remain inside the casing.

2. The method of claim 1, wherein the armor elements are ceramic elements.

3. The method of claim 1, wherein the casing provider arrangement is a direct or indirect metal profile extrusion arrangement extruding a metal profile around the armor elements.

4. The method of claim 1, wherein the casing provider arrangement is a pultrusion arrangement.

5. The method of claim 1, wherein the armor elements are configured to stay in place with a stopper when the armor elements are covered with the casing.

6. The method of claim 1, wherein the armor elements are supported with guides on at least two sides such that the guides move forward when the casing is supplied around the armor elements.

7. A method for inserting armor elements to a casing structure, the method comprising:

manufacturing a uniform casing comprising a front part, a back part, and at least one side part between the front part and the back part, at least one opening being defined within the at least one side of the casing; and inserting armor elements through the at least one opening in cavities of the casing.

8. The method of claim 7, wherein the armor elements are aligned on a conveyor that inserts the armor elements in the cavities of the casing.

9. The method of claim 7, wherein the armor elements are attached inside the casing by casting or injecting adhesive material inside the casing via arranged channels.

10. The method of claim 7, wherein the armor elements are attached inside the casing by welding a gap arranged to the casing such that the contraction of the weld clamps the armor elements to their places inside the casing.

11. A ballistic armor comprising:

a plurality of armor elements capsuled in a casing; and a uniform casing forming a plurality of longitudinal cavities for the armor elements, the uniform casing comprising a front part, a back part, and at least one side part between the front part and the back part, at least one opening being defined within the at least one side of the casing to receive the armor elements therethrough.

12. The ballistic armor of claim 11, wherein the casing is a metallic casing.

13. The ballistic armor of claim 11, wherein the armor elements are ceramic elements.

14. The ballistic armor of claim 11, wherein the cavities and armor elements are arranged in layers such that the cavities and armor elements in each layer are overlapping the cavities and layers in an adjacent layer.

15. The ballistic armor of claim 11, wherein the ballistic armor comprises a plurality of intermediate elements between the armor elements, the intermediate elements differing by material attributes from the armor elements.

16. The ballistic armor of claim 11, wherein the casing has a curved structure, and wherein the armor elements are arranged in a curved formation.

17. The ballistic armor of claim 11, wherein the cavities and armor elements have varying shapes and/or sizes.

18. The ballistic armor of claim 11, wherein at least two casings are connected to each other by an attachment system allowing the casings to turn relative to each other.

19. The ballistic armor of claim 18, wherein the attachment system comprises shoulder structures that are attached to each other by welding, gluing and/or mechanical attachments and, wherein the cavities and armor elements are arranged such that the layers of armor elements overlap each other in a connecting point of the attachment system.

20. The ballistic armor of claim 11, wherein the ballistic armor is attached to a frame structure.

* * * * *